US008939508B2

(12) United States Patent
Charoenapornwatana

(10) Patent No.: US 8,939,508 B2
(45) Date of Patent: Jan. 27, 2015

(54) CHAIRS WITH FLEXIBLE SPRING BACKREST

(75) Inventor: Chokchai Charoenapornwatana, Samutprakarn (TH)

(73) Assignee: Chokchai Charoenapornwatana, Samutprakarn (TH)

( * ) Notice: Subject to any disclaimer, the term of this patent is extended or adjusted under 35 U.S.C. 154(b) by 1266 days.

(21) Appl. No.: 12/365,544

(22) Filed: Feb. 4, 2009

(65) Prior Publication Data

US 2009/0284060 A1 Nov. 19, 2009

Related U.S. Application Data

(60) Provisional application No. 61/097,121, filed on Sep. 15, 2008.

(30) Foreign Application Priority Data

May 13, 2008 (TH) ..... 080300638

(51) Int. Cl.
*A47C 3/00* (2006.01)
*A47C 7/44* (2006.01)

(52) U.S. Cl.
CPC ..... *A47C 7/445* (2013.01)
USPC ..... 297/296; 297/299

(58) Field of Classification Search
USPC ..... 297/296, 299
See application file for complete search history.

(56) References Cited

U.S. PATENT DOCUMENTS

| | | | | |
|---|---|---|---|---|
| 4,333,683 | A | 6/1982 | Ambasz | |
| 4,379,589 | A * | 4/1983 | Marino | 297/299 X |
| 4,549,764 | A | 10/1985 | Haedo | |
| 4,580,836 | A | 4/1986 | Verney | |
| 5,039,163 | A | 8/1991 | Tolleson | |
| 5,114,210 | A | 5/1992 | Naess | |
| 5,904,397 | A | 5/1999 | Fisman | |
| 6,406,096 | B1 | 6/2002 | Barile, Sr. | |
| 6,679,551 | B2 | 1/2004 | Ware et al. | |
| 6,739,663 | B2 * | 5/2004 | Gevaert | 297/296 X |
| 6,820,934 | B2 | 11/2004 | Ware et al. | |
| 7,249,801 | B2 | 7/2007 | Tonin | |
| 7,410,215 | B2 | 8/2008 | Dehli | |
| 7,416,252 | B2 | 8/2008 | Lor | |
| 7,469,962 | B2 * | 12/2008 | Paulin | 297/229 X |

* cited by examiner

*Primary Examiner* — Anthony D Barfield
(74) *Attorney, Agent, or Firm* — Steven L. Nichols; Van Cott, Bagley, Cornwall & McCarthy P.C.

(57) ABSTRACT

A chair comprises at least a seat assembly, an armrest, a backrest, and a spring linkage. The backrest frame ends are connected to the upstanding back-leg frame ends of the seat assembly by the spring linkages to make a chair with a flexible spring backrest. Each spring linkage is of a U-shaped configuration having two ends spaced vertically apart; the upper end attached to the backrest frame and the lower end attached to the back-legs of the seat assembly. The tip of the spring linkage serves as a pivotal axis, allowing the backrest to be flexible and bend backwards in response to an applied force while returning to its normal position when the force is removed.

41 Claims, 9 Drawing Sheets

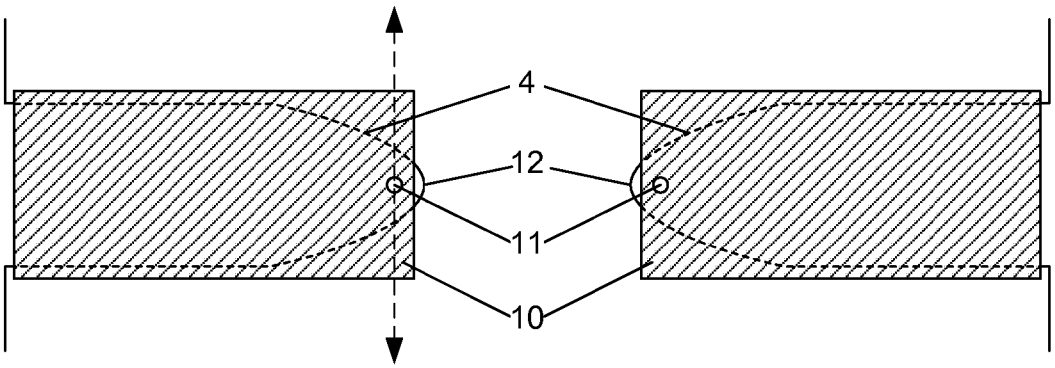
Fig. 4
Fig. 3
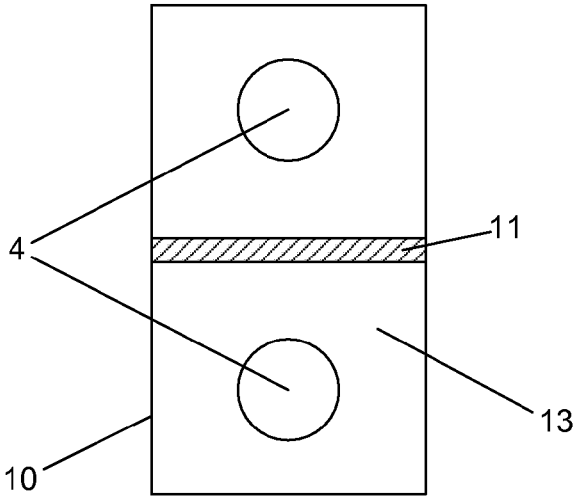
Fig. 4

CHAIRS WITH FLEXIBLE SPRING BACKREST

RELATED APPLICATION

The present application is related to and claims the priority under 35 U.S.C. §119(e) of U.S. Provisional Patent Application No. 61/097,121, entitled "Chairs With Flexible Spring Backrest," filed Sep. 15, 2008, which previous application is hereby incorporated by reference in its entirety.

BACKGROUND

It is known that when sitting in a simple straight back chair for a long period of time, one can experience strain on the back and neck muscles. Ergonomists have suggested that minimizing strain requires frequent relaxation of the muscles which can be done by leaning back from time to time.

Many present inventions are aimed at allowing the user to lean back; however, they tend to be complex or difficult to install. Many of these inventions have multiple parts causing them to be costly and time consuming to manufacture. Some chairs that allow the user to lean back have the backrest attached directly to the seat, forcing the seat to tilt back with the backrest. Other chairs have vertical spring systems attaching the backrest to the seat assembly. These are often embedded in the hollow tubing used to construct the chair, complicating the manufacturing process. Many chairs with flexible backrests have bulky spring systems, taking away from the chairs aesthetic value.

SUMMARY

The purpose of this invention is to have a chair with a flexible backrest which is simple and cost effective to construct. This invention will also allow the chair to maintain its aesthetic value. Additionally, the chair is safe and reliable; there is very little probability of falling over backwards from too much force exerted while leaning back.

The objective of this invention will be accomplished by using a spring linkage attaching the backrest to the back legs of the seat assembly. The spring linkage will allow the backrest to bend backward when force is exerted, relieving muscle fatigue of the user, and then return to its normal position after the force exerted is removed.

Other prior arts include flexible backrests which use various methods, some including springs; however, while most other chairs have vertical springs, this invention is made up of a horizontal spring system that will twist to the side when force is exerted on the backrest. When the force is removed, the backrest and the spring linkage will return to their normal positions.

BRIEF DESCRIPTION OF THE DRAWINGS

FIG. 3 is a detailed illustration of the springs according to an embodiment of the present invention.

FIG. 4 is a side view of the springs of FIG. 3 according to an embodiment of the present invention.

DETAILED DESCRIPTION

In the following description, for purposes of explanation, numerous specific details are set forth in order to provide a thorough understanding of the present systems and methods. It will be apparent, however, to one skilled in the art that the present systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Figure 1:
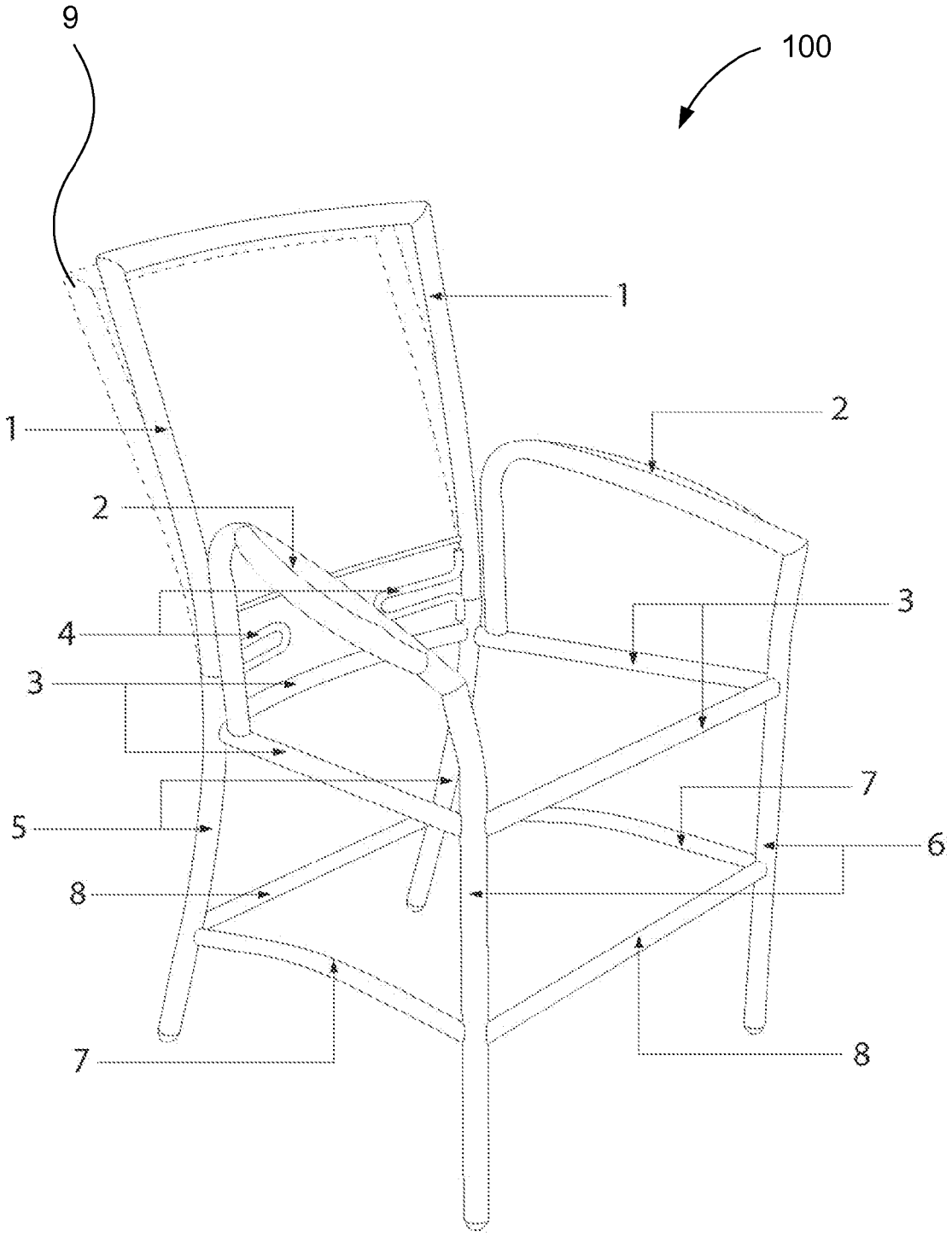
FIG. 1 is a front perspective of a chair illustrating the backrest portion in flexed displacement according to an embodiment of the present invention.
Figure 2:
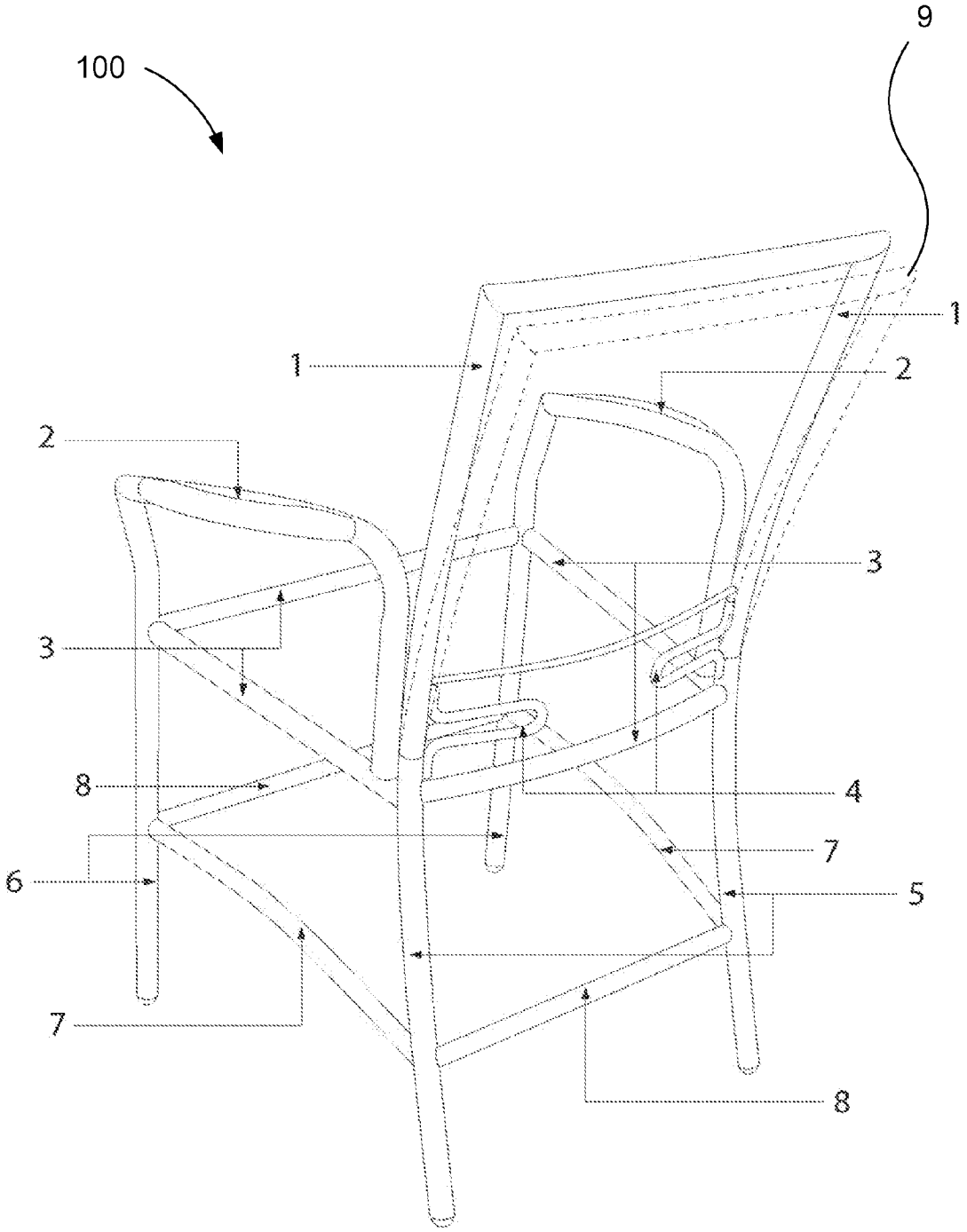
FIG. 2 is a rear perspective view of the chair of FIG. 1 according to an embodiment of the present invention.

FIG. 1 is a front perspective of a chair (100) and illustrating the backrest portion in flexed displacement according to an embodiment of the present invention. FIG. 2 is a back perspective view of the chair (100) of FIG. 1 according to an embodiment of the present invention. The chair (100) consists of a seat assembly including the seat support frame (3), two depending front-leg members (6), two depending back-leg members (5), a pair of side segments (7) connecting the front legs to the back legs, and a pair of side segments (8) connecting the left legs to the right legs.

In one exemplary embodiment the armrest (2) may be formed as an extension of the front legs (6) into an inverted U-shape with the other end connected to the side segment adjacent to the connection between the back legs (5) and the backrest frame (1). This placement of the armrests will give the user something to hold on to while leaning back, thus decreasing the probability of falling over backwards. The armrest may be of a different configuration as that disclosed here. Thus, any suitable configuration besides the U-shape may be used. The specific structural configuration of the armrest is within the skill of the art.

The backrest frame (1) includes a peripheral U-shaped frame. In one exemplary embodiment, the backrest frame (1) may include a backrest pad or cushion in between the frame. Any suitable configuration of the backrest frame (1) besides the U-shape may be used. The specific structural configuration of the backrest is within the skill of the art.

In one exemplary embodiment, the seat assembly, backrest frame (1), and armrest frame (2) may be formed of metal tubing. However, any material may be used in forming these various elements. For example, materials such as strong polymeric material, composition material, wood, molded plywood or the like may also be used. Further, the cross-sectional configurations may be of any shape including, but not exhaustive of, rectangular, circular, or any other suitable configuration. Specific structural configurations are within the skill of the art.

Spring Linkage System

The spring linkage system connects the backrest frame (1) to the back-leg members (5). In one exemplary embodiment, a pair of identical springs (4) may be used for both sides of the chair (100). The springs (4) may be made from any material that is flexible and has sufficient strength to limit the elongation, flexibility, and ultimate yield strength of the springs (4). For example, the springs (4) may be made of any material ranging from steel, polymeric material, or cable wire. In general, the springs (4) may be made of a resilient material that is sufficiently flexible to allow for a desired level of movement between a backrest frame (1) and back-leg members (5) when the spring is connected between the backrest frame (1) and back-leg members (5). Further, the springs (4) may be made of a sufficiently rigid material to prevent the backrest frame (1) from reclining too far back with respect to the back-leg members (5).

The flexible springs (4) may take various shapes and forms. In one exemplary embodiment, the springs (4) may be of a general U-shape configuration with two ends vertically spaced apart, as depicted in FIGS. 1 and 2. In another exemplary embodiment, the springs (4) may be of a general W-shape. In yet another exemplary embodiment, the springs (4) may have any number of horizontal protrusions depending on the required flexibility of the springs (4). The springs (4) may be of any shape that provides enough strength to support the backrest frame (1).

The upper end of the springs (4) may connect to the bottom ends of the backrest frame (1), while the lower end of the springs (4) may connect to the top ends of the back-leg members (5). This indirect connection between the bottom ends of the backrest frame (1) and the top ends of the back-leg members (5) allow the backrest to be flexed independently of the back-leg members (5). When force is applied or the body leans backward, the backrest frame (1) will bend backwards with respect to a pivotal axis or flexing axis located at the tip of the springs (4). This pivotal axis will also allow the backrest frame (1) to return to its normal position once the force is removed.

In one exemplary embodiment, the chair (100) may be provided with any number of springs (4). As disclosed above, and in one embodiment, the chair (100) may be provided with two springs (4) located on each side of the chair (100). Such a configuration may provide a more mechanically sound chair (100). Further, providing two springs (4) may provide a more ergonomic chair (100). Finally, providing two springs (4) may appear more aesthetically pleasing. However, in another exemplary embodiment, it is possible to have a single spring (4) connecting one of the bottom ends of the backrest frame (1) to the matching top end of the back-leg members (5).

Hinges may be provided between the backrest frame (1) and back-leg members (5). The hinges support movement between the backrest frame (1) and back-leg members (5) while ensuring that the bottom ends of the backrest frame (1) and the top ends of the back-leg members (5) remain vertically aligned. The hinges may be protected with a covering so that a user's clothing, fingers, etc. do not get stuck in the hinges.

Both FIGS. 1 and 2 illustrate the backrest frame (1) in flexed displacement according to an embodiment of the present invention. As indicated by the dashed outline (9), the backrest frame (1) may be displaced with respect to the rest of the chair (100), and, specifically, with respect to the seat assembly. In this manner, as a person sits in the chair (100), the two springs (4) may flex, thus causing the backrest frame (1) to be displaced with respect to the seat assembly. In an exemplary embodiment, the backrest frame (1) may be configured to be displaced at an angle between 0° and 180° with respect to the seat assembly. In another embodiment, the backrest frame (1) may be configured to be displaced at an angle between 90° and 180° with respect to the seat assembly.

FIG. 3 is a detailed picture of the springs (4) between the backrest and the seat assembly according to an embodiment of the present invention. The springs (4) may be covered with a casing (10) made up of metal or any other suitable material. This casing (10) may serve as a safety feature by ensuring that foreign objects such as clothing, a user's fingers, etc. do not get stuck or pinched in the springs (4) during use of the chair (100). Further, the casing (10) may serve to restrict the spring (4) from bending too much and allowing the backrest to flex too far backwards. A pin (11) may be placed just inside the tip (12) of the springs (4). This pin (11) may be fastened on both sides of the casing (10) and is used to prevent the casing (10) from slipping off of the springs (4).

FIG. 4 is a side view of the springs (4) of FIG. 3 according to an embodiment of the present invention. Specifically, FIG. 4 shows a side view of the springs (4) inside the casing (10) with a pin (11) used to secure the casing (10) to the springs (4). As depicted in FIG. 4, the casing (10) is larger than the spring (4), leaving a space (13) between the casing and the spring (4). This may allow the springs (4) to bend only as much as desired. A specific width and thickness of the casing (10) may be provided such that the springs (4) will only bend far enough to allow the backrest frame (FIGS. 1 and 2, 1) to go as far back as needed.

Figure 5:
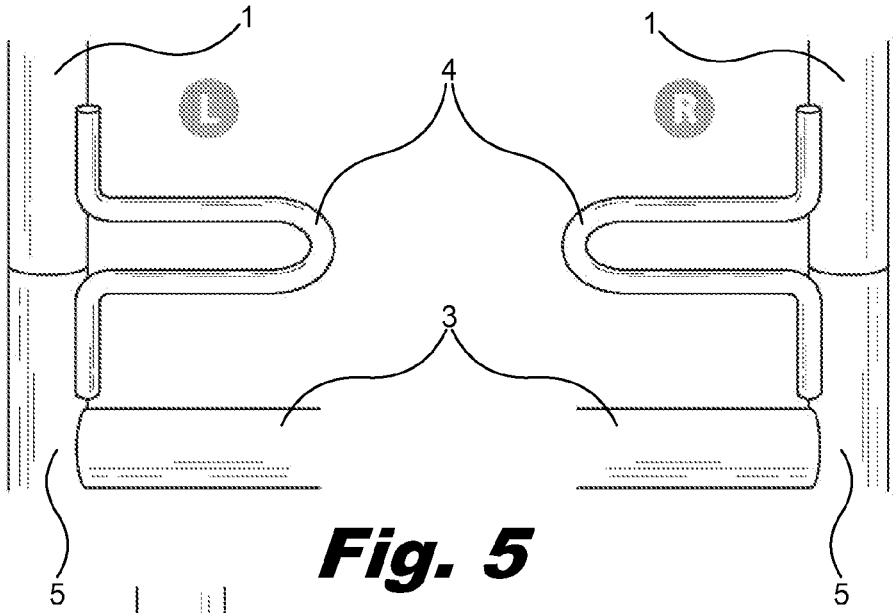
FIG. 5 is a schematic view of left and right springs according to an embodiment of the present invention.
Figure 6:
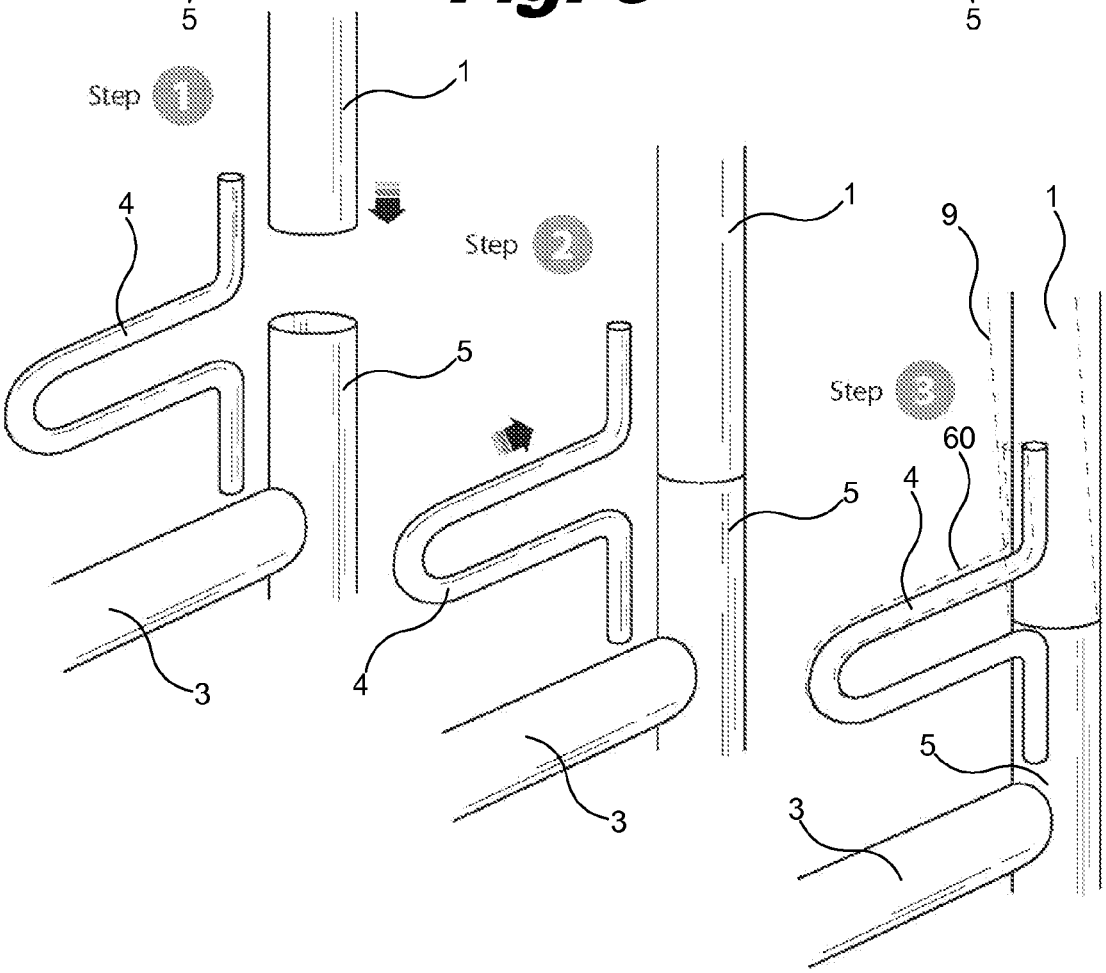
FIG. 6 is a progressive illustration depicting a method of coupling a spring between a backrest frame and a back leg member of a chair according to an embodiment of the present invention.

FIG. 5 is a schematic view of left and right springs according to an embodiment of the present invention. As illustrated in FIG. 5, the u-shaped springs (4) may be coupled between the backrest frame (10) and the back-leg members (5). FIG. 6 is a progressive illustration depicting a method of coupling a spring (4) between a backrest frame (1) and a back leg member (5) of a chair (FIG. 1, 100) according to an embodiment of the present invention. As depicted at step 1 of FIG. 6, the backrest frame (1) and the back leg member (5) may be brought in proximity with each other. In one embodiment, the backrest frame (1) and the back leg member (5) may be brought in contact with each other. In another embodiment, the backrest frame (1) and the back leg member (5) may be coupled via the spring (4), as will be discussed in more detail below, such that the backrest frame (1) moves with respect to the back leg member (5), and may be further configured to return to an original position after a force is reduced on the backrest frame (1). In yet another embodiment, the backrest frame (1) and the back leg member (5) may be pivotably coupled. In one exemplary embodiment, the pivotable coupling of the backrest frame (1) and the back leg member (5) may be accomplished via a joint.

In step 2 of FIG. 6, the spring (4) may be brought into proximity to the backrest frame (1) and the back leg member (5). As depicted in FIG. 6, and in one exemplary embodiment, the spring (4) may couple the backrest frame (1) to the back leg member (5), and be aligned such that half of the spring (4) is above the backrest frame (1)/back leg member (5) interconnect, and the other half of the spring (4) is below the backrest frame (1)/back leg member (5) interconnect.

In step 3 of FIG. 6, and as described above in connection with FIGS. 1 and 2, the backrest frame (1) may be flexibly displaced as indicated by the dashed outline (9). Specifically, the backrest frame (1) may be displaced with respect to the seat assembly. Further, the spring may also be displaced as indicated by the dashed outline (60) as the spring (4) flexes.

Figure 7:
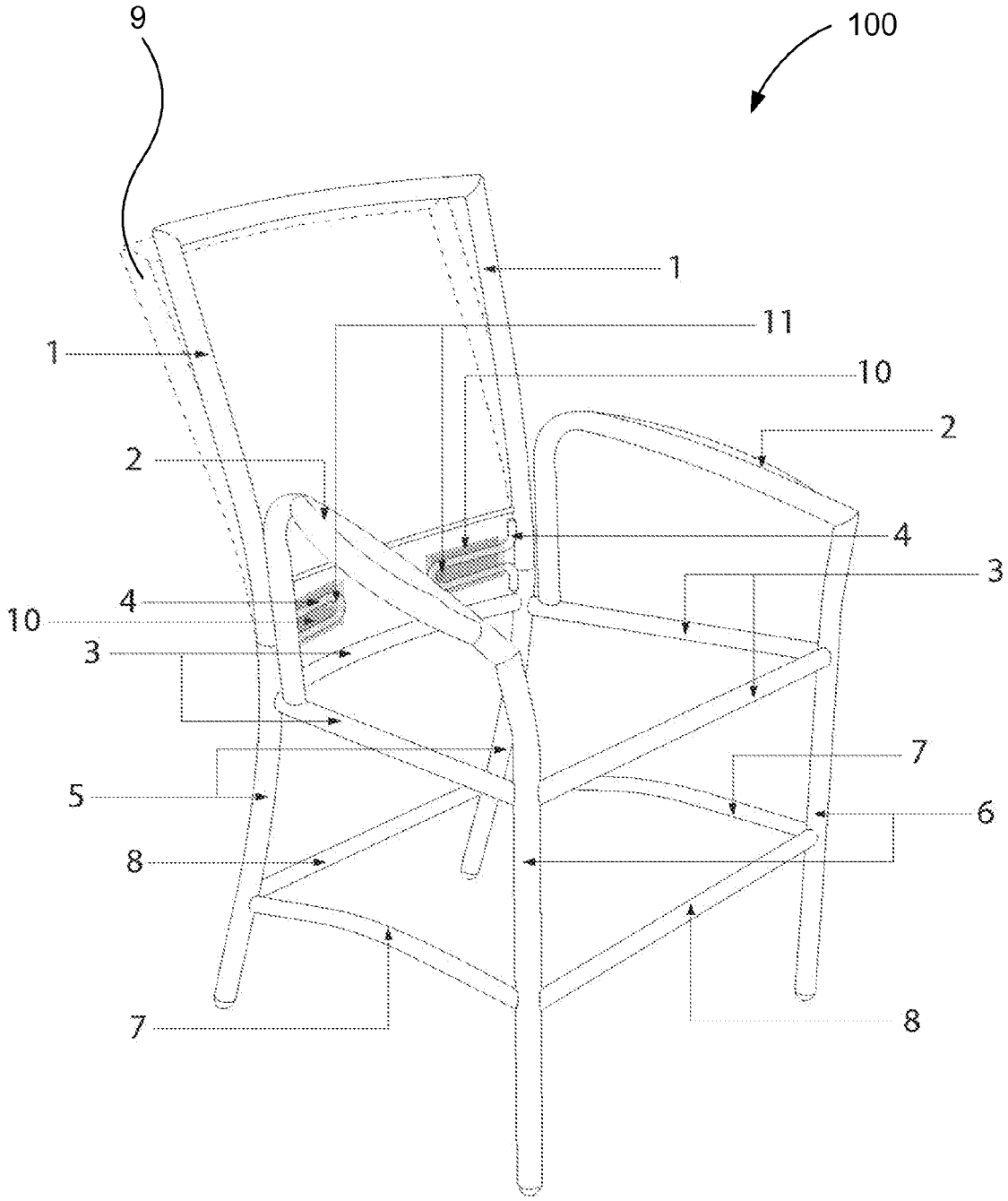
FIG. 7 is a front perspective of the chair of FIG. 1 illustrating casings according to an embodiment of the present invention.
Figure 8:
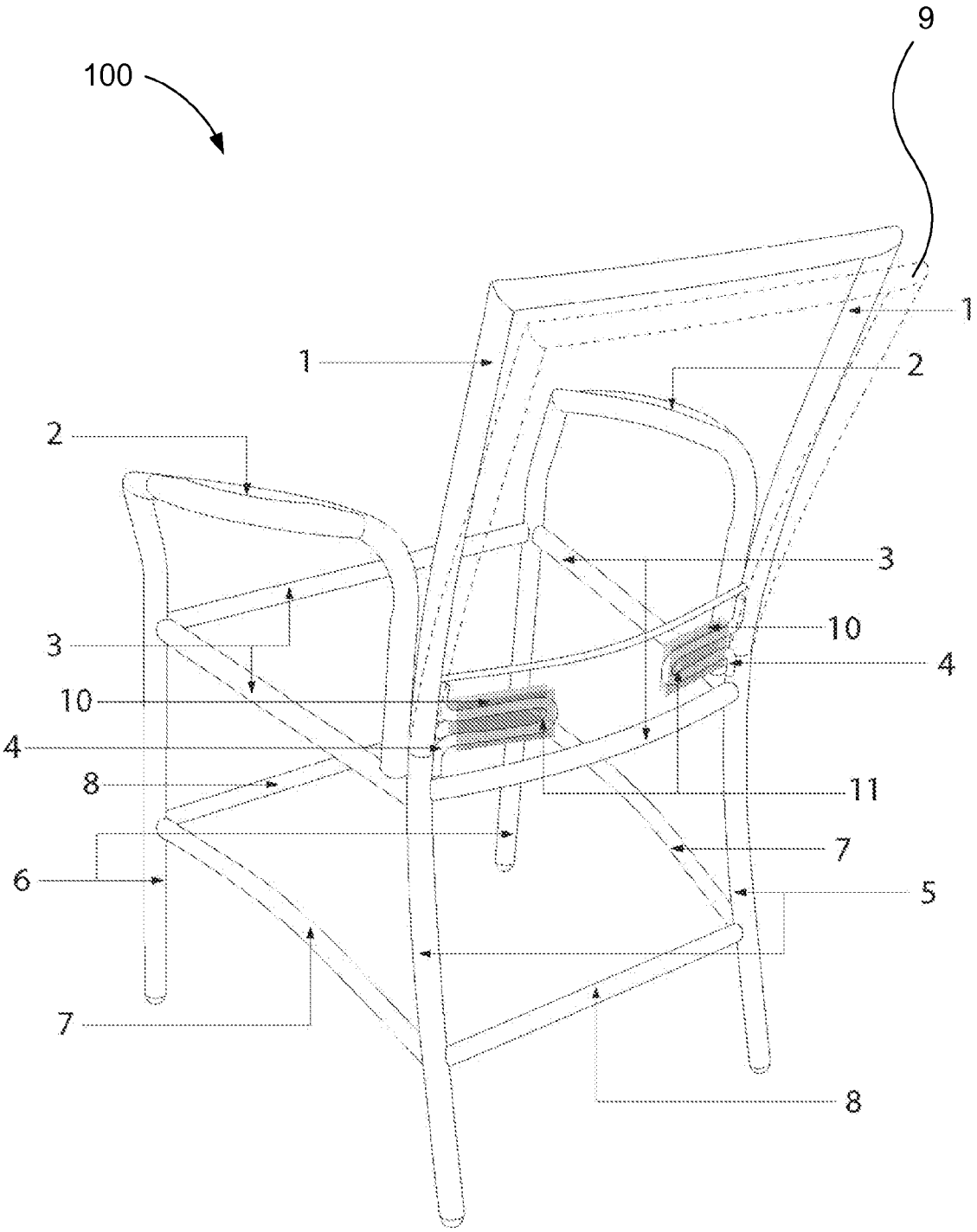
FIG. 8 is a back perspective of the chair of FIG. 7 according to an embodiment of the present invention.

FIG. 7 is a front perspective of the chair (FIG. 1, 100) of FIG. 1 illustrating casings (10) according to an embodiment of the present invention. Further, FIG. 8 is a back perspective of the chair (FIG. 1, 100) of FIG. 7 according to an embodiment of the present invention. The casings (10) may cover all or a portion of the springs (4).

Figure 9:
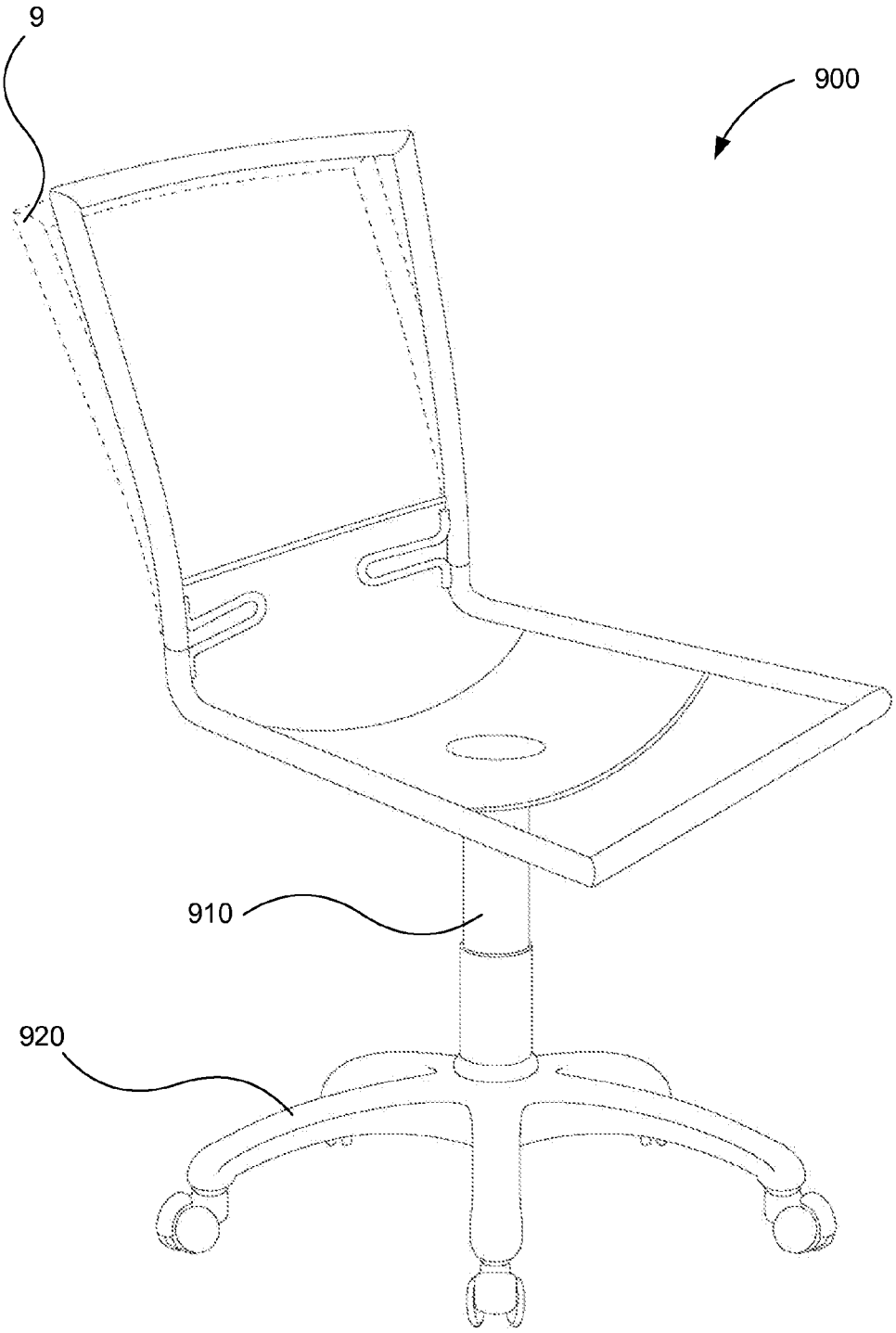
FIG. 9 is a front perspective of a chair illustrating the backrest portion incorporating springs according to another embodiment of the present invention.
Figure 10:
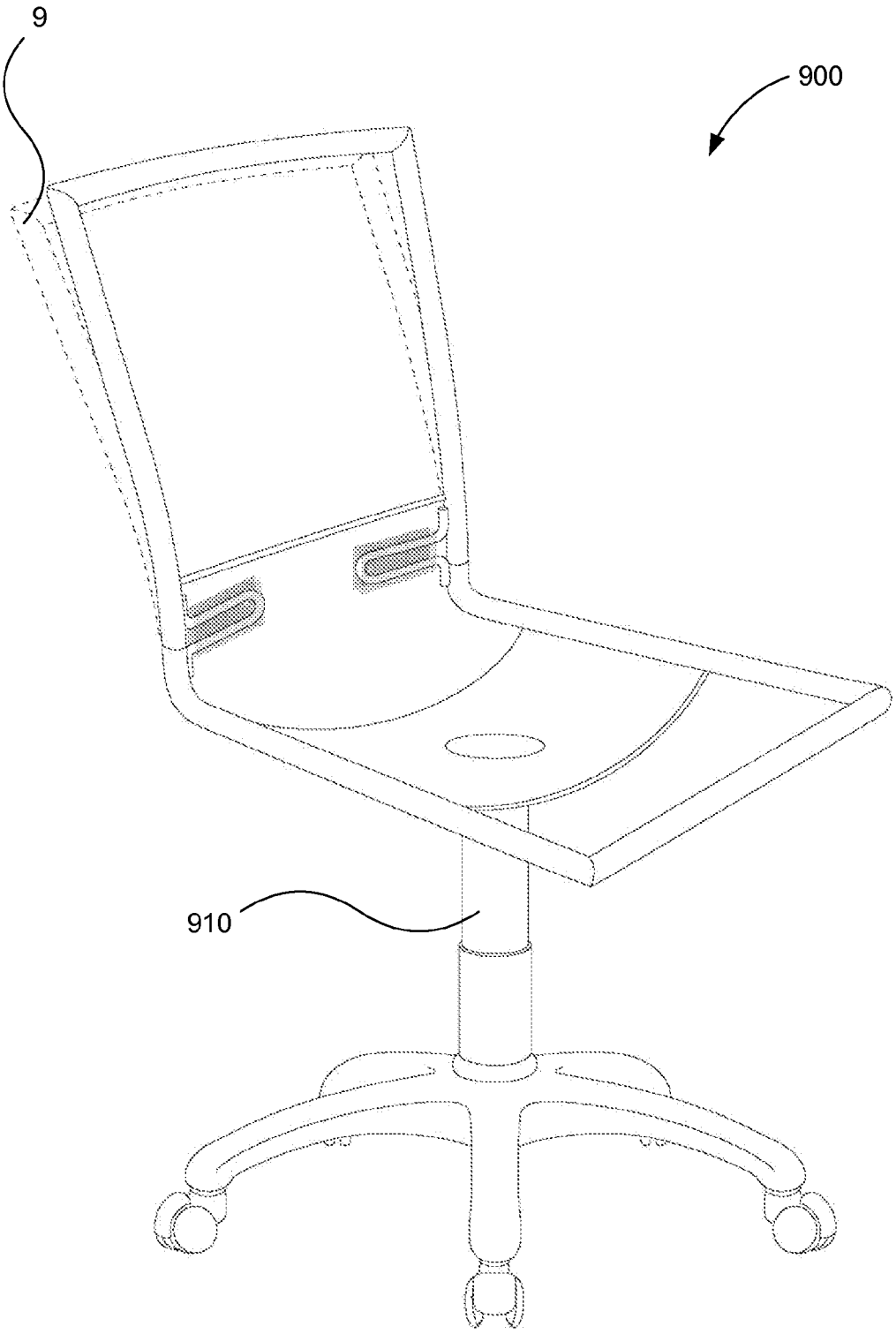
FIG. 10 is a front perspective of the chair of FIG. 9 illustrating a casing according to an embodiment of the present invention.

FIG. 9 is a front perspective of a chair illustrating the backrest portion incorporating springs according to another embodiment of the present invention. Further, FIG. 10 is a front perspective of the chair of FIG. 9 illustrating casings (10) according to an embodiment of the present invention. The chair (900) of FIGS. 9 and 10 may include a column (910) and a number of legs (920). In one embodiment, the column (910) may be configured to adjust the height of the chair (900). In another embodiment, the column (910) may be located directly under, and attached to the center of gravity of the chair (900).

The number of legs (920) may be attached to the bottom of the column (910), and may further be coupled to the column (910) in a fan-like configuration. In one embodiment, a number of wheels may be coupled to the bottom of the number of legs (920) so that the chair (900) may roll across a floor.

Figure 11:
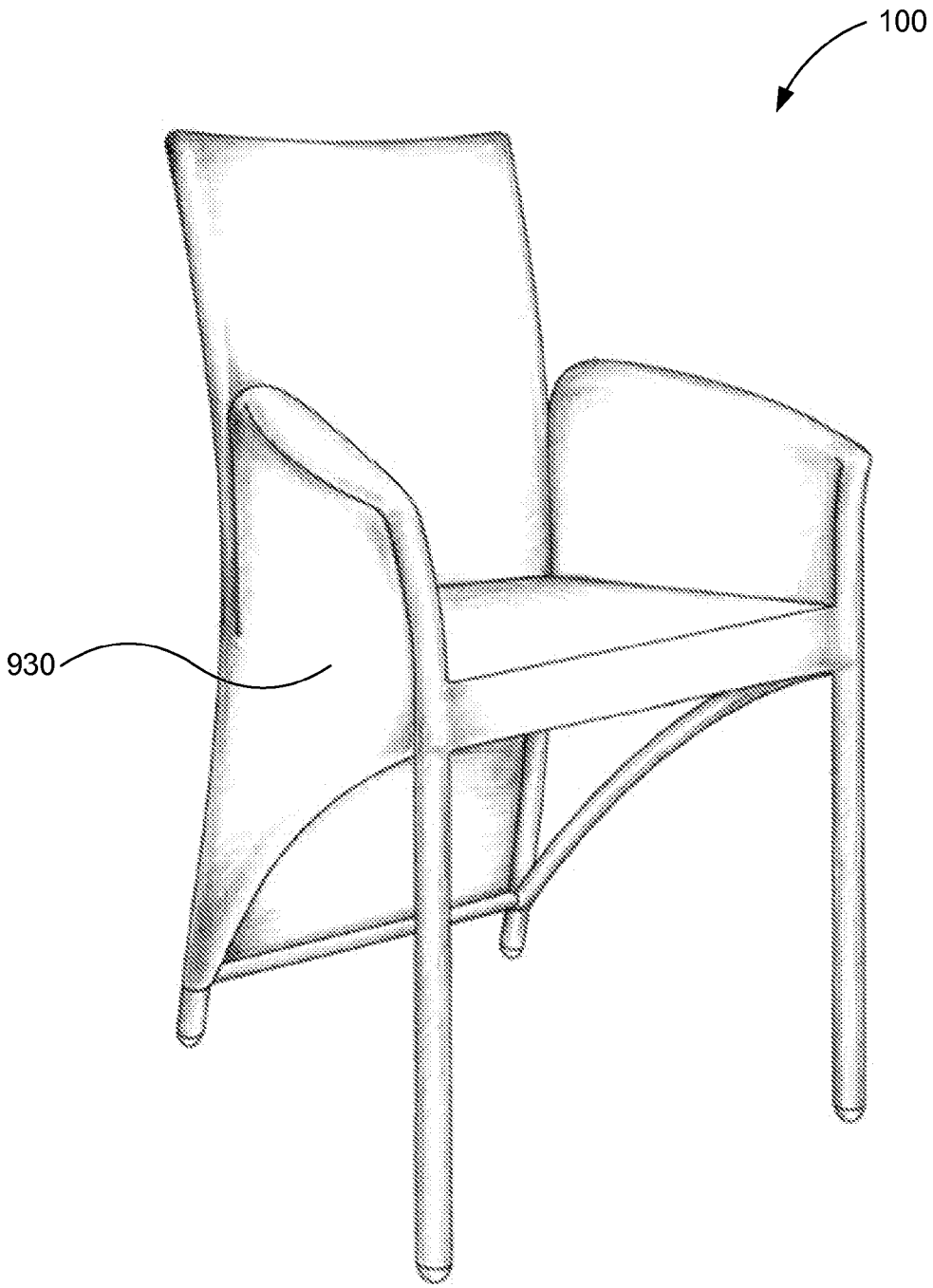
FIG. 11 is a front perspective of the chair of FIG. 1 incorporating a covering according to an embodiment of the present invention.

FIG. 11 is a front perspective of the chair of FIG. 1 incorporating a covering (930) according to an embodiment of the present invention. The chair (FIG. 1, 100) is structured such that the covering (930) may adhere to the contours of the chair (FIG. 1, 100). Specifically, the springs (4) are configured such that they do not protrude or otherwise deviate from the contours of the chair (FIG. 1, 100). Thus, the cover (930) may cover at least a portion of the chair (FIG. 1, 100) with no convex surfaces being created in the covering. In one embodiment, the covering (930) may be configured to cover the backrest frame (1), and, specifically, the springs (4). In another embodiment, the cover (930) may be configured to cover the entire chair. The covering may comprise any material, and may act as a covering material, cushioning material, or both. Further, other layers of covering may be fitted around the chair (FIG. 1, 100).

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A chair comprising:
a seat assembly;
a backrest frame; and
a number of springs coupling the seat assembly to the backrest frame, the springs torsionally flex along a pivotal axis; and
a number of casings surrounding the springs, in which the casings restrict the springs from bending beyond a predetermined degree.

2. The chair of claim 1, further comprising:
at least two front legs connected to the seat assembly; and
at least two back legs connected to the seat assembly.

3. The chair of claim 2, wherein the upper end of the springs are connected to the bottom end of the backrest frame and the lower end of the springs are connected to the top ends of the back legs.

4. The chair of claim 2, wherein the backrest frame is pivotably connected to the back legs.

5. The chair of claim 2, wherein the springs are made of a resilient material configured to provide movement of the backrest frame with respect to the back legs.

6. The chair of claim 5, wherein the springs are made of a rigid material configured to limit the level of movement between the backrest frame and the back legs.

7. The chair of claim 1, further comprising a number of fasteners configured to retain the casings on the springs.

8. The chair of claim 1, wherein the springs are of a u-shape wherein the two ends of the u-shaped springs are vertically spaced apart.

9. The chair of claim 1, wherein the springs are made of a resilient material configured to provide a desired level of displacement of the backrest frame.

10. The chair of claim 1, wherein the springs are made of a rigid material configured to limit the level of displacement of the backrest frame.

11. The chair of claim 1, wherein the springs are made of a material selected from the group consisting of steel, a polymeric material, metal, and cable wire.

12. The chair of claim 1, wherein the springs are of a w-shape wherein the two ends of the w-shaped springs are vertically spaced apart.

13. The chair of claim 1, wherein the springs comprise a number of horizontal protrusions.

14. The chair of claim 1, in which the springs are configured to flexibly displace the backrest frame with respect to the seat assembly.

15. The chair of claim 14, wherein the backrest frame and the seat assembly are pivotably coupled.

16. The chair of claim 14, further comprising:
a column coupled to the seat assembly; and
a number of legs coupled to the column.

17. The chair of claim 16, further comprising a number of wheels coupled to the legs.

18. The chair of claim 14, further comprising:
a column coupled to the seat assembly; and
a number of base substrates coupled to the end of the column opposite the seat assembly.

19. The chair of claim 18, further comprising a number of wheels coupled to the base substrates.

20. The chair of claim 14, further comprising a covering configured to cover a portion of the chair.

21. The chair of claim 20, wherein the covering is configured to cover portions of the chair selected from the group consisting of the seat assembly, the backrest, and combinations thereof.

22. The chair of claim 21, further comprising:
at least two front legs connected to the seat assembly; and
at least two back legs connected to the seat assembly,
wherein the covering is further configured to cover portions of the front legs and back legs.

23. A spring linkage system for use in a chair, comprising:
a number of springs configured to connect a backrest frame of the chair to a number of back legs of the chair;
wherein the springs are of a u-shape,
wherein the two ends of the u-shaped springs are vertically spaced apart, and
in which the springs torsionally flex along a pivotal axis located at a distal end of the springs with respect to the two ends of the springs.

24. The spring linkage system of claim 23, wherein the springs are made of a resilient material configured to provide movement of the backrest frame with respect to the back legs.

25. The spring linkage system of claim 24, wherein the springs are made of a rigid material configured to limit the level of movement between the backrest frame and the back legs.

26. The spring linkage system of claim 23, wherein the springs are made of a material selected from the group consisting of steel, a polymeric material, metal, and cable wire.

27. A method of manufacturing a reclining chair, comprising:

forming a seat assembly;

forming a backrest frame;

coupling the backrest frame to the seat assembly via a number of springs, in which the springs are coupled to the backrest frame and seat assembly to create a torsional spring force; and surrounding the springs with a number of casings, in which the casings restrict the springs from bending beyond a predetermined degree.

28. The method of claim 27, further comprising:

coupling at least two back legs to the back of the seat assembly; and connecting the upper end of the springs to the bottom end of the backrest frame and connecting the lower end of the springs to the top ends of the back legs.

29. The method of claim 28, wherein the springs are of a u-shape wherein the two ends of the u-shaped springs are vertically spaced apart.

30. The method of claim 28, wherein the springs are made of a resilient material configured to provide movement of the backrest frame with respect to the back legs.

31. The method of claim 28, wherein the springs are made of a rigid material configured to limit the level of movement between the backrest frame and the back legs.

32. The method of claim 27, further comprising providing a number of fasteners wherein the fasteners are configured to retain the casings on the springs.

33. The method of claim 27, further comprising pivotably connecting the backrest frame to the back legs.

34. The method of claim 27, wherein the springs are made of a material selected from the group consisting of steel, a polymeric material, and cable wire.

35. The method of claim 27, further comprising a cover configured to cover at least a portion of the chair.

36. The method of claim 35, wherein the cover is configured to cover the backrest frame and the springs.

37. A method of manufacturing a reclining chair, comprising:

forming a seat assembly;

forming a backrest frame;

coupling the backrest frame to the seat assembly via a number of springs, in which the springs are coupled to the backrest frame and seat assembly to create a torsional spring force;

surrounding the springs with a number of casings, in which the casings restrict the springs from bending beyond a predetermined degree; and coupling a column to the seat assembly.

38. The method of claim 37, further comprising coupling a number of legs to the column.

39. The method of claim 38, further comprising coupling a number of wheels to the legs.

40. The method of claim 37, further comprising coupling a number of base substrates to the end of the column opposite the seat assembly.

41. The chair of claim 40, further comprising coupling a number of wheels to the base substrates.

* * * * *